US007937876B1

(12) United States Patent
Graham

(10) Patent No.: US 7,937,876 B1
(45) Date of Patent: May 10, 2011

(54) FIREARM PIN COMPONENT

(75) Inventor: James J. Graham, Westhampton, MA (US)

(73) Assignee: Yankee Hill Machine Co., Inc., Florence, MA (US)

( * ) Notice: Subject to any disclaimer, the term of this patent is extended or adjusted under 35 U.S.C. 154(b) by 156 days.

(21) Appl. No.: 12/464,133

(22) Filed: May 12, 2009

Related U.S. Application Data

(60) Provisional application No. 61/076,722, filed on Jun. 30, 2008.

(51) Int. Cl.
*F41A 21/00* (2006.01)

(52) U.S. Cl. ..... 42/75.03; 42/75.01; 42/75.02

(58) Field of Classification Search ..... 42/75.01–75.04; 411/351, 482; 403/315–328, 355
See application file for complete search history.

(56) References Cited

U.S. PATENT DOCUMENTS

| | | | | | |
|---|---|---|---|---|---|
| 694,156 | A | * | 2/1902 | Johnson | 42/75.03 |
| 705,234 | A | * | 7/1902 | Hartley | 42/75.02 |
| 2,345,127 | A | | 3/1944 | Kehne | |
| 2,817,174 | A | | 12/1957 | Liedke | |
| 3,171,182 | A | | 3/1965 | Danehy | |
| 3,250,559 | A | | 5/1966 | Sommerfeld | |
| 3,386,336 | A | * | 6/1968 | Roy | 89/128 |
| 3,739,515 | A | | 6/1973 | Koon, Jr. | |
| 3,776,095 | A | | 12/1973 | Atchisson | |
| 3,943,817 | A | * | 3/1976 | Mess | 411/385 |
| 4,231,177 | A | | 11/1980 | Foote | |
| 4,358,987 | A | | 11/1982 | Wilhelm | |
| 4,416,186 | A | | 11/1983 | Sullivan | |
| 4,457,076 | A | | 7/1984 | Heck | |
| 4,509,281 | A | | 4/1985 | Dreiling et al. | |
| 4,648,191 | A | * | 3/1987 | Goff et al. | 42/75.02 |
| 4,742,636 | A | | 5/1988 | Swan | |
| 4,934,885 | A | * | 6/1990 | Woods et al. | 411/44 |
| 4,936,282 | A | | 6/1990 | Dobbins et al. | |
| 5,155,284 | A | * | 10/1992 | Flashkes | 42/75.02 |
| 5,239,767 | A | | 8/1993 | Briley, Jr. et al. | |
| 5,333,515 | A | | 8/1994 | Schneider | |
| 5,630,406 | A | | 5/1997 | Dumont | |
| 5,659,992 | A | | 8/1997 | Mistretta | |
| 5,900,577 | A | | 5/1999 | Robinson et al. | |
| 6,023,891 | A | * | 2/2000 | Robertson et al. | 52/125.4 |

(Continued)

FOREIGN PATENT DOCUMENTS

| | | |
|---|---|---|
| JP | 10102873 | 4/1998 |

*Primary Examiner* — Bret Hayes
*Assistant Examiner* — Joshua Freeman
(74) *Attorney, Agent, or Firm* — Deborah A. Basile; Karen K. Chadwell

(57) ABSTRACT

A take down front pin and take down rear pin designed to simplify the process whereby an upper receiver is engaged with and disengaged from a lower receiver of a firearm. Each of the take down front and rear pins comprises a body having attached to a proximal end thereof a positioning member, wherein, when the pins are properly positioned to engage the upper receiver to the lower receiver, the positioning member protrudes from a main frame of the lower receiver. Furthermore, in addition to the positioning of the positioning member on the firearm such that it protrudes from the lower receiver, thereby making the respective pin easily accessible, the positioning member is also configured to facilitate the manual sliding of the pin to, within, from, and without engaging elements located on the upper and lower receiver of the firearm.

7 Claims, 3 Drawing Sheets

U.S. PATENT DOCUMENTS

| | | | | |
|---|---|---|---|---|
| 6,311,603 | B1 | 11/2001 | Dunlap | |
| 6,508,144 | B1 | 1/2003 | Vendetti et al. | |
| 6,722,072 | B1 | 4/2004 | McCormick | |
| 6,739,082 | B2 | 5/2004 | Christensen | |
| 7,162,823 | B2 * | 1/2007 | Schoppman et al. | 42/75.01 |
| 2003/0089014 | A1 | 5/2003 | Schuerman | |
| 2005/0241211 | A1 | 11/2005 | Swan | |
| 2006/0112605 | A1 | 6/2006 | Sopko | |
| 2006/0156607 | A1 | 7/2006 | Curry et al. | |
| 2006/0283067 | A1 * | 12/2006 | Herring | 42/75.01 |
| 2007/0199435 | A1 | 8/2007 | Hochstrate et al. | |
| 2007/0277669 | A1 | 12/2007 | Tertin | |

* cited by examiner

PRIOR ART

PRIOR ART

FIREARM PIN COMPONENT

CROSS REFERENCE TO RELATED APPLICATIONS

This application claims the benefit of U.S. Provisional Application No. 61/076,722 filed on Jun. 30, 2008.

BACKGROUND TO THE INVENTION

1. Field of the Invention

The present invention relates to gun parts. More particularly, the present invention relates to pins for firearms and to the structure of said pins, wherein exemplary pins include take down pins and receiver pivot pins.

2. Background of the Invention

In the prior art the disassembly of the upper receiver from the lower receiver of a firearm, for purposes of cleaning and lubrication for example, has typically required tools and has often resulted parts of the gun becoming lost whereby reassembly was rendered impossible. Additionally, since the upper receiver is typically connected to the lower receiver by means of a take down pin and a receiver pivot pin, there has been an ever present danger that the forces to which the pins were subjected during movement of the upper receiver relative to the lower receiver would result in either the bending of the pins, thereby preventing diassembly, or the actual breakage thereof. Thus, there has been a long standing desire in the art to provide means whereby a weapon could be taken down, i.e., the upper receiver disassembled from the lower receiver, without tools, without any significant danger of loss of parts, and without sacrificing the requisite strength of the mechanism which couples the upper receiver to the lower receiver.

SUMMARY OF THE INVENTION

From the foregoing, it may be appreciated that a need has arisen for a take down front pin and take down rear pin designed to simplify the process whereby an upper receiver is engaged with and disengaged from a lower receiver of a firearm. Each of the take down front and rear pins comprises a body having attached to a proximal end thereof a positioning member and a pulling member, such that when the pins are properly positioned to engage the upper receiver to the lower receiver, the positioning member protrudes outwardly from a main frame of the lower receiver, and the pulling member extends outwardly from an opposite side of the main frame.

Furthermore, in addition to the positioning of the positioning member on the firearm such that it protrudes from the lower receiver, thereby making the respective pin easily accessible, the knob is also configured to facilitate the manual sliding of the pin to, within, from, and without engaging elements located on the upper and lower receiver of the firearm without the need of any tools.

Other advantages, objects and features of the present invention will be readily apparent to those skilled in the art from a review of the following detailed descriptions of a preferred embodiment in conjunction with the accompanying drawings.

DETAILED DESCRIPTION OF THE INVENTION

Figure 1:
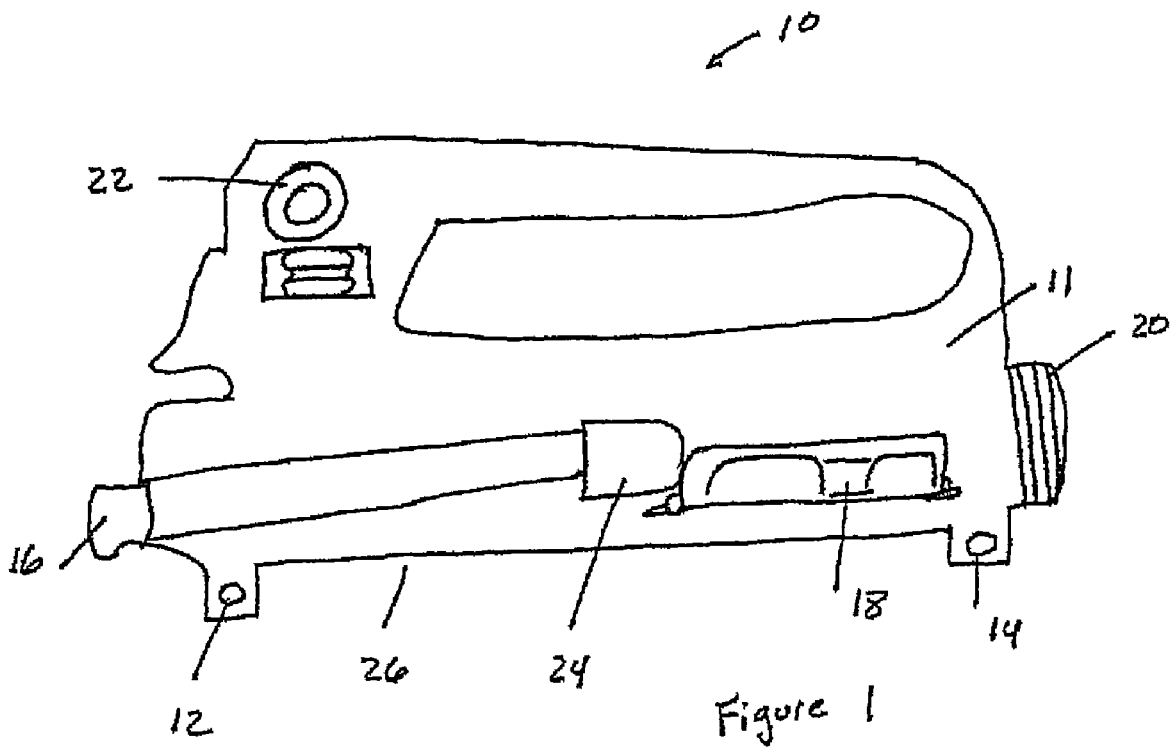
FIG. 1 is a schematic depicting an exemplary prior art upper receiver.
Figure 2:
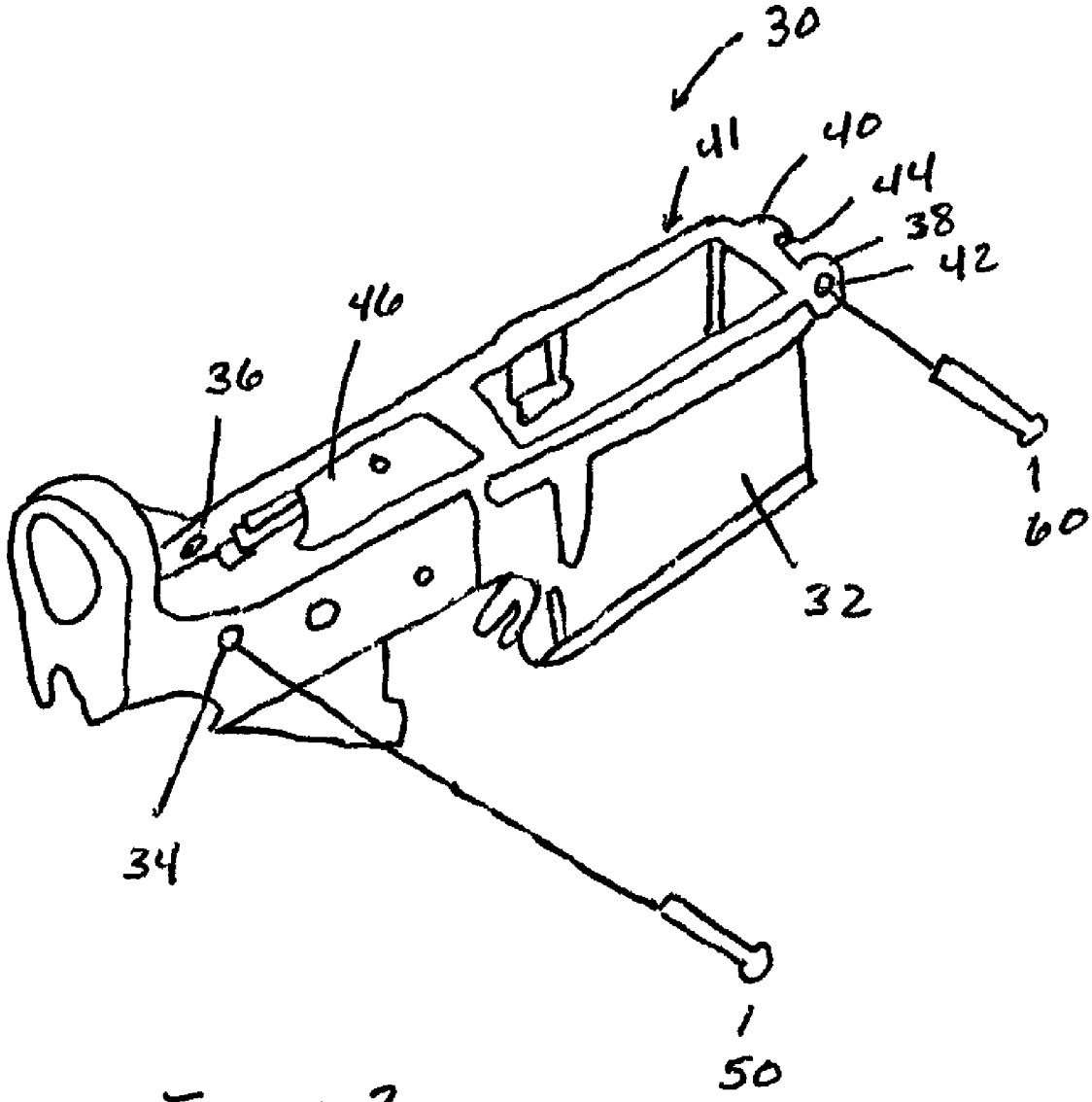
FIG. 2 is a schematic depicting an exemplary prior art lower receiver.

The present inventive device relates to the take down pins for firearms. As used herein and throughout, "take down pin" refers to the pin or pins which secure and hold the upper receiver of the firearm to the lower receiver of the firearm, and include what is conventionally known as take down pins (referred to herein at times as the "take down rear pin") and receiver pivot pins (referred to herein at times as the "take down front pin"). To provide a proper frame of reference for the present invention, FIGS. 1 and 2 are provided, wherein FIGS. 1 and 2 respectively show exemplary prior art upper and lower receivers for an AR-15. It is to be understood, however, that the inventive take down pins disclosed herein may be utilized on take down pins designed and/or implemented for use on a variety of differently designed and configured upper and lower receivers for any number of firearms, wherein the basic principle of design and operation of the inventive take down pins are the same.

Referring to FIG. 1, a prior art upper receiver 10 comprises a main body 11 having extending from a bottom side thereof a rear take down lug 12 and a front pivot pin lug 14. Upper receiver 10 further comprises a forward assist 16, an ejection port cover 18, and a barrel attachment point 20 to which the barrel of the firearm is attached. Upper receiver 10 may further comprise a variety of accessories, including, for example, a rear sight assembly 22 and a case deflector 24.

Referring to FIG. 2, an exemplary prior art lower receiver 30 comprises a main frame 32 having a hole 34 and a hole 36 born through the sides therethrough. Protrusions 38 and 40 extend from a distal end 41 of main frame 32, and each of protrusions 38 and 40 has a respective hole 42 and 44 born therethrough. A top surface 46 of main frame 32 is configured to receive a bottom surface 26 of upper receiver 10 such that rear take down lug 12 is aligned with hole 34 and hole 36, and such that front pivot pin lug 14 is aligned with holes 42 and 44. Once aligned, a take down rear pin 50 is inserted through holes 34 and 36 and through rear takedown lug 12, and a take down front pin 60 is inserted through holes 42 and 44 and through front pivot pin lug 14.

Traditionally, when it is desired to remove upper receiver 10 from, or to pivot upper receiver 10 relative to lower receiver 30, tools, such as one or more screwdrivers, are required to release and slide the take down pins from their respective engaging elements, i.e., from rear take down lug 12 and holes 34 and 36 for take down rear pin 50, and from front pivot pin lug 14 and holes 42 and 44 for take down front pin 60. This is because the head of the pin is typically secured tightly and flush to main frame 32 of lower receiver 30.

Accordingly, as it is an object of the present invention to eliminate the need for tools for the engagement and disengagement of the upper and lower receivers relative to each other, the present invention comprises a uniquely developed take down pin configured to protrude from the main frame of the lower receiver such that it provides a finger grip whereby a user can readily slide the take down pin to, within, from, and without its respective engaging elements.

The take down pins of the present invention will now be discussed with reference to FIGS. 3 and 4. More particularly, an exemplary take down rear pin 100 shall be disclosed with reference to FIG. 3, and an exemplary take down front pin 200 shall be disclosed with reference to FIG. 4, wherein it is understood that the pins shall not be limited to the embodiments depicted in the figures as the depicted embodiments are exemplary and provided for illustrative purposes only. It is also herein noted that many of the features shown and described for take down rear pin 100 are essentially identical to those features shown and described for take down front pin 200. Accordingly, those essentially identical features shall be identified with the same reference numbers, and those features that are distinct between the two types of pins 100 and 200 shall be shown and described with reference to different reference numerals.

Figure 3:
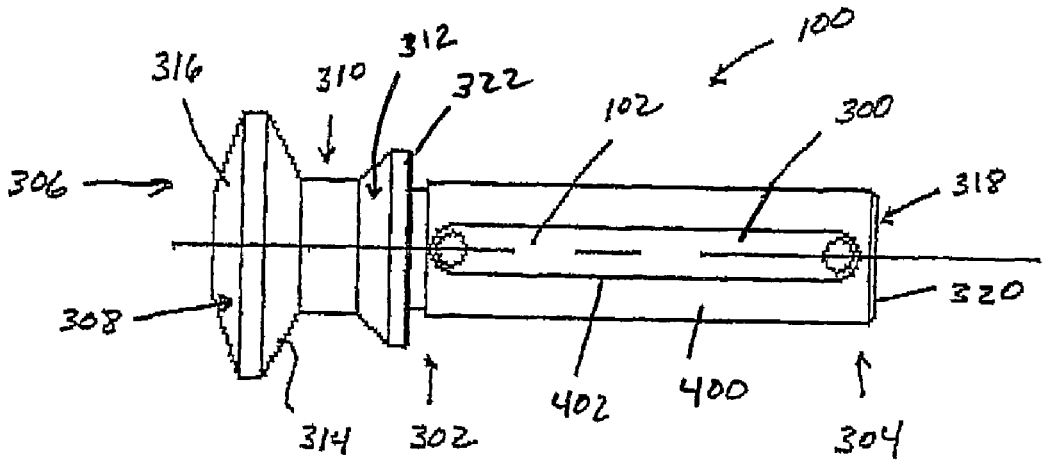
FIG. 3 is a schematic depicting an exemplary take down rear pin.
Figure 4:
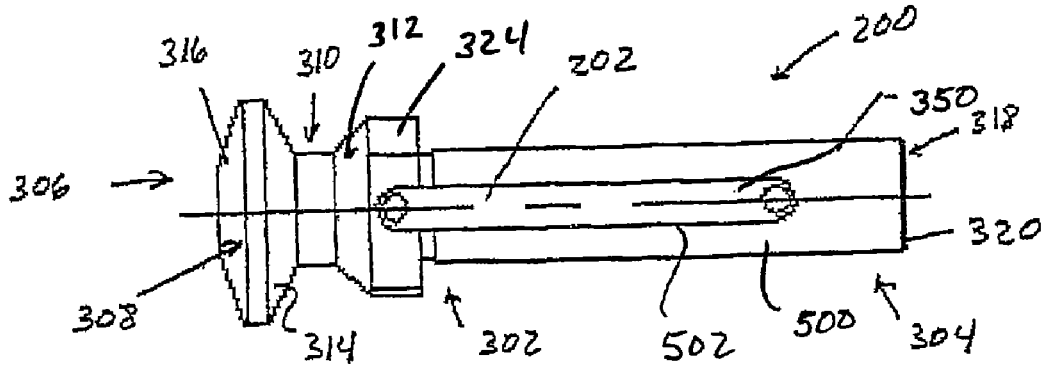
FIG. 4 is a schematic depicting an exemplary take down front pin.

Referring to FIGS. 3 and 4, take down pins 100 and 200 each comprises a respective elongated cylindrical body 300 and 350, wherein body 300 is defined at its outermost ends by a proximal end 302 opposite to a distal end 304. To prevent take down rear pin 100 and take down front pin 200 from disengaging from lower receiver 30, pin 100 comprises a sleeve 400 having a slot 402 formed therethrough, and pin 200 comprises a sleeve 500 having a slot 502 formed therethrough. It is noted herein, that the invention is not limited to the embodiments of the pins disclosed herein, but may be adapted to a wide variety of firearm pins both currently known and to be known. To that end, the pins need not comprise, for example, the sleeves depicted in the figures.

Attached to and disposed on proximal end 302 is a positioning member, which is in the form of a knob 306. Knob 306 is designed to facilitate take down rear pin 100's and take down front pin 200's disengagement from the engaging members, i.e., from respective rear takedown lug 12 and holes 34 and 36, and from respective front pivot pin lug 14 and from holes 42 and 44, by allowing knob 306 to be manually pulled away from main frame 32 of lower receiver 30. Knob 306 is also configured to facilitate take down rear pin 100's and take down front pin 200's engagement with their respective engaging members by allowing knob 306 to be manually pushed towards main frame 32 of lower receiver 30.

To that end, referring to FIGS. 3 and 4, in an exemplary embodiment, knob 306 comprises a body having an overall thimble-like configuration comprising a middle portion 310 recessed between a head portion 308 and a base portion 312. Head portion 308 comprises an underside 314 which provides a grip surface for pulling take down pins 100 and 200 away from main frame 32, and an upper side 316 which provides a surface for pushing pins 100 and 200 towards main frame 32. Middle portion 310 creates a space between head portion 308 and base portion 312 whereby the space is of sufficient size to allow a user's finger to gain enough leverage on underside 314 to pull take down pins 100 and 200 away from main frame 32 or to push take down pins 100 and 200 towards main frame 32.

It is herein noted that although a knob 306 has been specifically described herein as an exemplary embodiment, it is contemplated that the positioning member may comprise a wide variety of structures and configurations, and may comprise, for example a ring, loop, or any other member which allows the pins to be easily pulled from, and pushed towards, the engaging members.

As shown in the figures, base portion 312 of knob 306 is attached to a head 322 located at proximal end 302 of body 300 of pin 100, and to a head 324 located at proximal end 302 of body 350 of pin 200. Such attachment may be accomplished directly by integrally connecting base portion 312 to head 322 as may be accomplished, for example, by welding knob 306 to head 322, or may be accomplished indirectly by, for example, using a screw to attach knob 306 to head 322.

Additionally, in an exemplary embodiment, take down pins 100 and 200 may further comprise a push member 318 which is either integral with or distinct from distal end 304 of respective bodies 300 and 350. The purpose of push member 318, which in an exemplary embodiment, comprises an elongated body extending from respective bodies 300 and 350, which terminates at a leading edge 320, is to provide a contact point on pins 100 and 200 which allows pins 100 and 200 to be pushed away from their respective engagement members to provide an alternative means of releasing pins 100 and 200 therefrom. Accordingly, when pins 100 and 200 are properly engaged with their respective engaging members, and the upper receiver is locked onto the lower receiver thereby, a user need only push on leading end 320 of push member 318 to slide pins 100 and 200 out from rear takedown lug 12 and holes 34 and 36, and from front pivot pin lug 14 and holes 42 and 44. In this manner, then, push member 318 may be utilized to further assist in the movement of take down pins 100 and 200 by hand to facilitate disengagement of upper receiver 10 from lower receiver 30 without the use of any tools.

The inventive take down pins disclosed herein allow for the ready manual engagement and disengagement of upper receiver 10 to and from lower receiver 30 without the need for tools, implements, instruments, and the like. For example, in an exemplary embodiment, upper receiver 10 may be pivotally moved in relation to lower receiver 30, wherein such movement is helpful when it is desired, for example, to clean the firearm. In this embodiment, a user may pull on knob 306 of take down rear pin 100 by placing the user's index finger and middle finger around middle portion 310 and pressing on underside 314 of knob 306 with such a force that take down rear pin 100 moves outside of hole 36 and outside of rear take down lug 12 but maintains a hold within hole 34. Alternatively, or additionally, the user may apply a force against leading end 320 of push member 318 of take down rear pin 100 to accomplish this same affect. Upon removal of take down rear pin 100 from hole 36 and rear take down lug 12, the user may apply an upward force on main body 11 of upper receiver 10 such that upper receiver pivots away from lower receiver 30 but maintains attached to lower receiver 30 by way of take down front pin 200.

Upper receiver 10 may again be securely held to lower receiver 30 by moving upper receiver 10 towards lower receiver 30 such that upper receiver 10 pivots towards lower receiver 30 until rear take down lug 12 is aligned with holes 34 and 36. Take down rear pin 100 is then pushed inwardly towards main frame 32 of lower receiver 30 by manually pushing with a user's fingers against upper side 316 of head portion 308 of knob 306 until take down pin 100 is again moved within hole 36 and rear takedown lug 12.

Similarly, upper receiver 10 may be entirely removed from lower receiver 30 by the manual disengagement of take down pin rear 100 from rear take down lug 12 and hole 36 and of take down front pin 200 from front pivot pin lug 14 from hole 44. To accomplish this, a user may exert a force directly against undersides 314 of head portions 308 of take down pins 100 and 200 until the pins are removed from the respective holes 12, 36, 14, and 44. Additionally or alternatively, the user may apply a force against leading end 320 of push member 318 of take down rear and front pins 100 and 200 to accomplish this same affect. Upper receiver 10 may then be lifted from lower receiver 30.

Upper receiver 10 may then be attached to lower receiver 30 by aligning rear take down lug 12 with holes 34 and 36 and front pivot pin lug 14 with holes 42 and 44. Bodies 300 and 350 of respective pins 100 and 200 may then be respectively inserted within rear take down lug 12 and hole 36 and within front pivot pin lug 14 and hole 44 by applying a pushing force against upper side 316 of pins 100 and 200 with, for example, the user's index finger.

In this manner then, the inventive take down pins of the present invention provide a simplified way for attaching and disconnecting the upper receiver from the lower receiver, wherein the user may accomplish such attachment or disengagement by manually pulling and/or pushing the pins without the need of a tool. Therefore, by providing take down pins having knobs which extend past the main frame of the lower receiver, and wherein the knobs are configured to allow a user to properly leverage the user's fingers on the knob, the inventive device has simplified the process for engaging and disengaging the upper receiver of a firearm from the lower receiver.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention.

What is claimed is:

1. A pin for use in engaging an upper receiver of a firearm to a lower receiver of the firearm and for disengaging the upper receiver from the lower receiver, comprising:

an elongated body having a proximal end opposite to a distal end, wherein when the pin is positioned on the firearm, the body extends between the upper receiver and the lower receiver;

a positioning member disposed on the proximal end of the body, wherein when the pin is positioned on the firearm, the positioning member extends outwardly from a first side of a main frame of the lower receiver, wherein the positioning member comprises a knob comprising an underside, a base portion, and a middle portion disposed between the underside and the base portion, and further wherein the base portion is disposed on the proximal end of the body, and the middle portion is recessed between the underside and the base portion; and a push member disposed on the distal end of the body, wherein the push member facilitates removal of the pin from the upper receiver by hand without the need for any tools, wherein when the pin is positioned on the firearm, the push member extends outwardly from a second side of the main frame of the lower receiver, wherein the first side of the main frame is opposite to the second side of the main frame.

2. The pin of claim 1, wherein the push member comprises an elongated body having a first end coterminous with the distal end of the body and having a leading edge opposite to the first end, wherein a user pushes on the leading edge of the push member to remove the pin from the upper receiver by hand without the use of any tools.

3. A firearm comprising:

an upper receiver comprising a main body comprising a rear take down lug opposite to a front pivot pin lug;

a lower receiver comprising a main frame having a distal lateral side opposite to a proximal lateral side, wherein the distal lateral side comprises a first hole towards a first end thereof and a second hole towards a second end thereof, and the proximal lateral side comprises a first hole towards a first end thereof and a second hole towards a second end thereof;

a first pin inserted through the first hole of the distal lateral side, the first hole of the proximal lateral side, and the rear take down lug; and a second pin inserted through the second hole of the distal lateral side, the second hole of the proximal lateral side, and the front pivot pin lug;

wherein the first pin and the second pin each comprises:

an elongated body having a proximal end opposite to a distal end, wherein when the pin is positioned on the firearm, the body extends between the upper receiver and the lower receiver; and a positioning member which extends outwardly from the distal lateral side of the main frame of the lower receiver, wherein the positioning member comprises a middle portion, an underside, and a base portion, wherein the base portion is disposed on the proximal end of the body, and wherein the middle portion is recessed between the underside and the base portion.

4. The firearm of claim 3, wherein each of the first pin and the second pin further comprises a push member disposed on the distal end of the body, wherein the push member facilitates removal of the respective pin from the upper receiver by hand without the need for any tools, and further wherein, when the respective pin is positioned on the firearm, the push member extends outwardly from the proximal lateral side of the main frame of the lower receiver.

5. The firearm of claim 4, wherein the push member comprises an elongated body having a first end coterminous with the distal end of the body and having a leading edge opposite to the first end, wherein a user pushes on a leading edge of the push member to remove the pin from the upper receiver by hand without the use of any tools.

6. A pin for use in engaging an upper receiver of a firearm to a lower receiver of the firearm and for disengaging the upper receiver from the lower receiver, comprising:

an elongated body having a proximal end opposite to a distal end, wherein when the pin is positioned on the firearm, the body extends between the upper receiver and the lower receiver;

a positioning member, wherein, when the pin is positioned on the firearm, the positioning member extends outwardly from a first side of a main frame of the lower receiver, wherein the positioning member comprises an underside, a base portion disposed on the proximal end of the body, and a middle portion recessed between the underside and the base portion.

7. The pin of claim 6, further comprising a push member disposed on the distal end of the body, wherein, when the pin is positioned on the firearm, the push member extends outwardly from a second side of the main frame of the lower receiver, wherein the first side of the main frame is opposite to the second side of the main frame.

* * * * *